United States Patent [19]

Wise

[11] 4,149,768

[45] Apr. 17, 1979

[54] COMPOSITE STRIP OF THERMOPLASTIC ARTICLES AND METHOD OF MANUFACTURING SAME

[75] Inventor: Joseph A. Wise, Hershey, Pa.

[73] Assignee: AMP Incorporated, Harrisburg, Pa.

[21] Appl. No.: 899,610

[22] Filed: Apr. 24, 1978

Related U.S. Application Data

[63] Continuation-in-part of Ser. No. 806,891, Jun. 15, 1977, abandoned.

[51] Int. Cl.[2] ..... H01R 11/08

[52] U.S. Cl. ..... 339/276 SF; 264/328; 425/134

[58] Field of Search ..... 339/218, 276 SF, 276 T; 425/134; 264/328

[56] References Cited

U.S. PATENT DOCUMENTS

| | | | |
|---|---|---|---|
| 2,964,171 | 12/1960 | Chadwick | 339/276 SF |
| 3,671,621 | 6/1972 | Fukuoka | 425/134 |
| 3,774,141 | 11/1973 | Condon | 339/276 SF |
| 3,940,218 | 2/1976 | Steels | 425/134 |

*Primary Examiner*—Joseph H. McGlynn
*Attorney, Agent, or Firm*—Frederick W. Raring

[57] ABSTRACT

A continuous strip of thermoplastic articles, such as electrical connecting device housings, has first and second portions defined by bands which extend along the entire length of the strip. The first band is of a first thermoplastic material which has optimum properties and characteristics for the parts of the articles which lie in the first band and the second band is of a second thermoplastic material which has optimum properties and characteristics for those portions of the article which lie in the second band of the continuous strip. In the case where the articles are connector housings, the first band may be of a material which has superior crimping characteristics while the second band may be of a material having optimum firmness and strength. The strip is manufactured by a continuous thermoplastic molding process in which the two materials are continuously extruded through a nozzle and into an endless series of side-by-side cavities in a molding wheel while the surface of the wheel was continuously moving past the nozzle.

13 Claims, 16 Drawing Figures

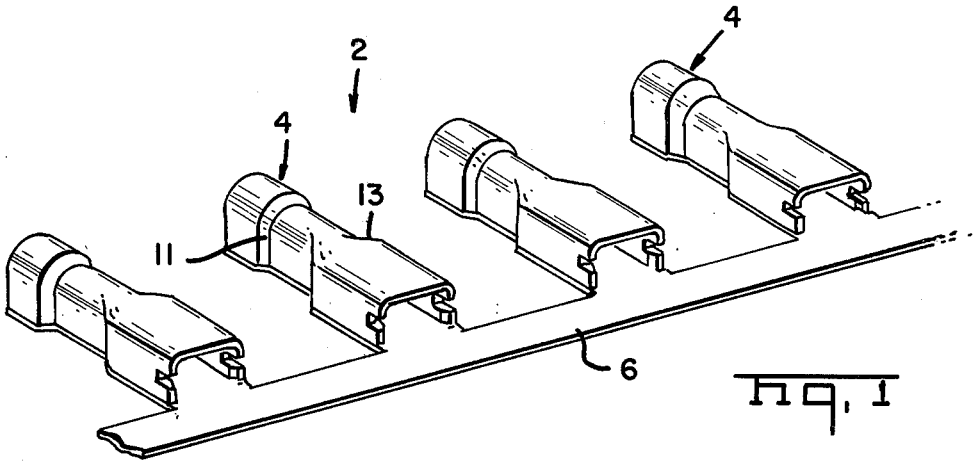
Fig. 1
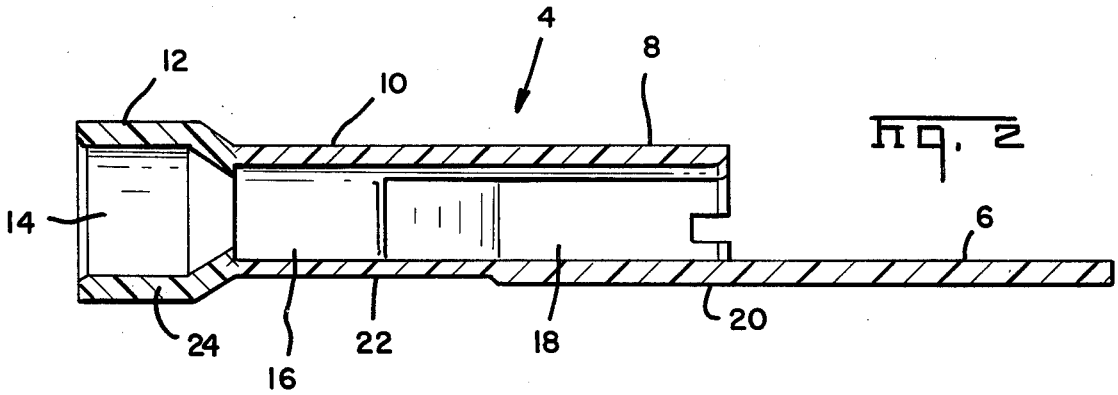
Fig. 2
Fig. 3
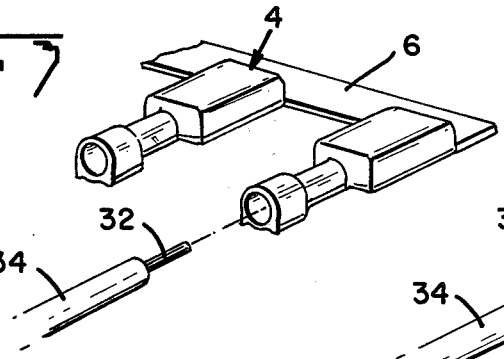
Fig. 4
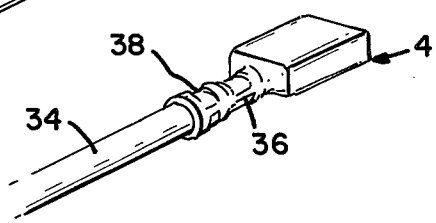

4

14
12

24
26
28
30
40
41
42
4
42
44

6
6
7
7
32
34

COMPOSITE STRIP OF THERMOPLASTIC ARTICLES AND METHOD OF MANUFACTURING SAME

This application is a continuation-in-part of Ser. No. 806,891, filed June 15, 1977, and now abandoned.

BACKGROUND OF THE INVENTION

This invention relates to molded thermoplastic articles in continuous strip form and to methods and apparatus for molding such articles. The embodiment of the invention described herein comprises a continuous strip of plastic housings for electrical connectors. However, it will be apparent that the principles of the invention can be used to produce many other plastic articles in continuous strip form.

Application Ser. No. 734,708 discloses and claims a continuous strip of molded thermoplastic electrical connector housings comprising a carrier strip from which the housings extend at spaced-apart intervals. Each housing has a cavity extending therethrough transversely of the length of the strip, these cavities being dimensioned to receive electrical contact terminals. Each housing has a wire-receiving end through which the stripped end of a wire can be inserted into the cavity to position the metallic core of the wire in the wire barrel portion of the terminal with the end portion of the insulation of the wire disposed in the housing at the wire-receiving end thereof. An intermediate portion of the housing is crimped and the compressive crimping forces are transmitted through the thermoplastic material to the wire barrel portion of the terminal to effect crimping of the terminal onto the wire. A portion of the housing at the wire-receiving end is also crimped onto the insulation of the wire to compress the housing into constrictive embracing relationship with the insulation thereby to provide some sealing effect and preferably, a strain relief for the wire so that when a tensile force is applied to the wire, the tensile force will not be transmitted to the crimped connection between the wire core and the wire barrel portion of the electrical terminal in the housing. Contact terminal devices in accordance with the teachings of Application Ser. No. 734,708 have been enthusiastically received in the electrical industry and are gaining widespread acceptance.

Connecting devices of the type shown in application Ser. No. 734,708 have heretofore been made with a commonly used thermoplastic material, 6—6 nylon polyester. This material has properties (such as strength, hardness, and dielectric strength which are well suited for most portions of the connector housing and this material will withstand crimping forces without fracture. The housing can thus be crimped onto the wire and the forces required to crimp the wire barrel portion of the terminal in the housing onto the wire will not cause cracking of the insulating housing. Many thermoplastic materials, including 6—6 nylon polyester, have a tendency to relax after they are permanently deformed, that is, after they are crimped, and while this relaxation may be unobjectionable under many circumstances, it does prevent the achievement of an extremely high quality crimped connection between the plastic housing and the insulation of the wire; in other words, the relaxation of the plastic detracts from the effectiveness of the insulation supporting crimp. As a result, sealing and a good strain relief between the wire and the housing are not obtained. Thus, housings in accordance with application Ser. No. 734,708 which are of conventional thermoplastic materials are satisfactory for most purposes although under some circumstances it would be desirable to have an improved insulation supporting crimp of the housing onto the wire for stain relief and sealing purposes.

In accordance with the teachings of the instant invention, electrical connector housings in continuous strip form are of two distinctly different, but compatible, thermoplastic materials, one of which has optimum properties for most portions of the electrical connector housing, those portions in which the contact terminal is contained, and the other of which has optimum physical properties for the portion of the housing which is crimped onto the insulation of the wire. Specifically, the portions of the housing which are crimped onto the wire insulation are of a material which, upon such deformation as takes place during crimping, remains permanently in its deformed condition and has no tendency to return to its original dimensions. The remaining portions of the housing are of material which has optimum properties as regards, for example, dielectric strength and hardness.

Continuous strip in accordance with the invention can be manufactured at extremely low cost and at very high production rates by injecting the two materials into mold cavities provided on the surface of a molding wheel while the molding wheel is rotating and the surface is moving past the nozzle of the injection molding apparatus. When the two materials are injected at spaced-apart locations into the mold cavities, the materials rapidly fill each cavity and the two fronts of the material meet and merge with each other to form a boundary zone in each of the molded articles. On one side of this boundary, the article or connector housing will be composed of the first material and on the other side it will be composed of the second material.

It is accordingly an object of the invention to provide an improved method of molding thermoplastic materials. A further object is to provide a method of producing endless strip of thermoplastic articles in side-by-side relationship with each article being composed of two different materials which are separated by a boundary zone. A further object is to provide a continuous strip of thermoplastic articles, each article comprising two separate thermoplastic materials. A further object is to provide an improved electrical connector housing in endless strip form. A further object is to provide an improved electrical connecting device which can be crimped onto the stripped end of a wire.

These and other objects of the invention are achieved in preferred embodiments thereof which are briefly described in the foregoing abstract, which are described in detail below, and which are shown in the accompanying drawing in which:

FIG. 1 is a perspective view of the section of thermoplastic strip of housings in accordance with the invention.

FIG. 2 is a sectional view taken along the lines 2—2 of FIG. 1.

FIGS. 3 and 4 are views illustrating the manner in which connecting devices in accordance with the invention are crimped onto the stripped ends of wires.

Figures 5, 6, 7:
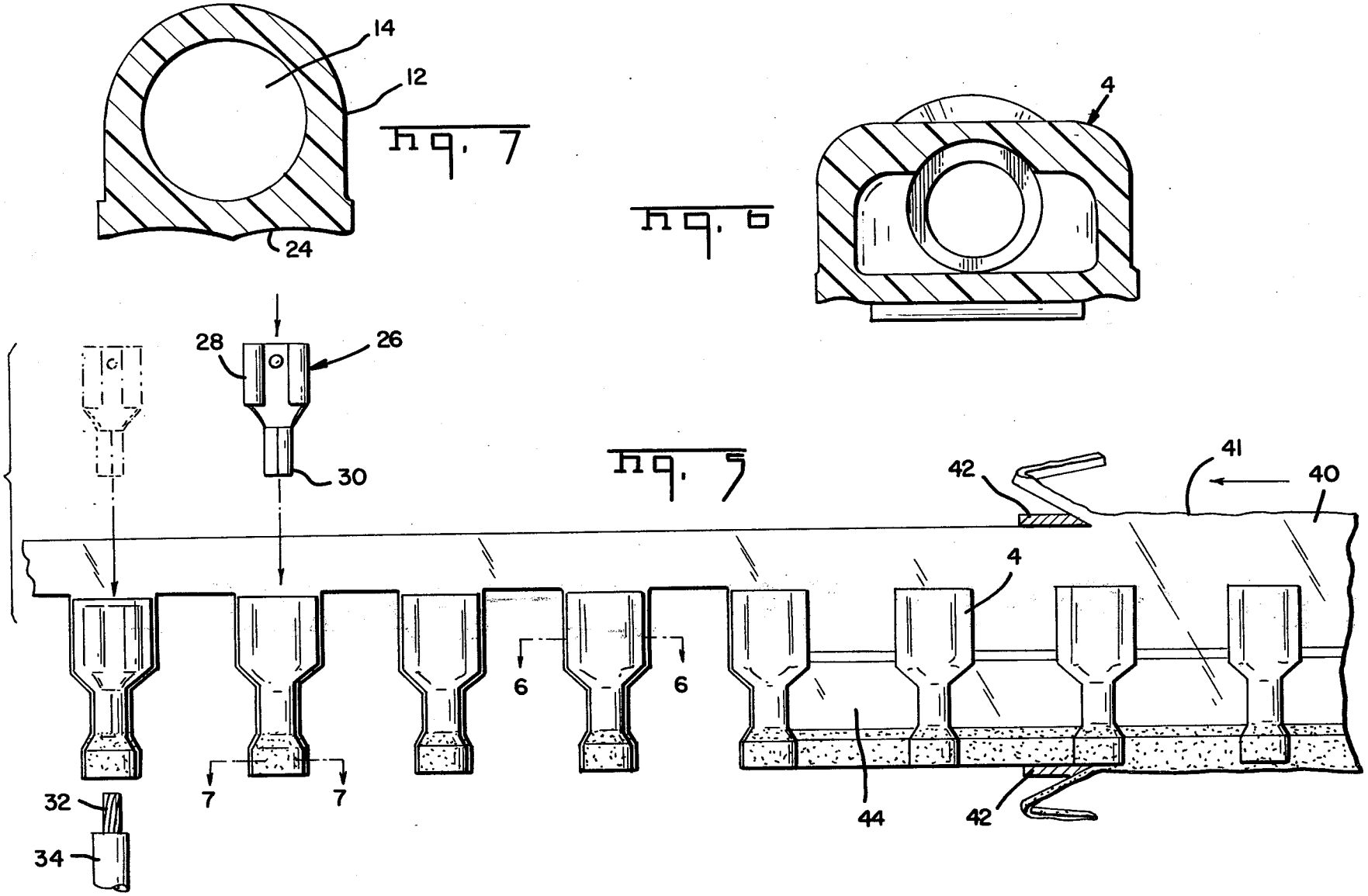
FIG. 5 is a plan view showing the continuous strip in the condition in which it is produced by the molding operation and illustrating the trimming, blanking, and assembly steps which are carried out to produce a strip of connecting devices containing contact terminals.
Figure 5:
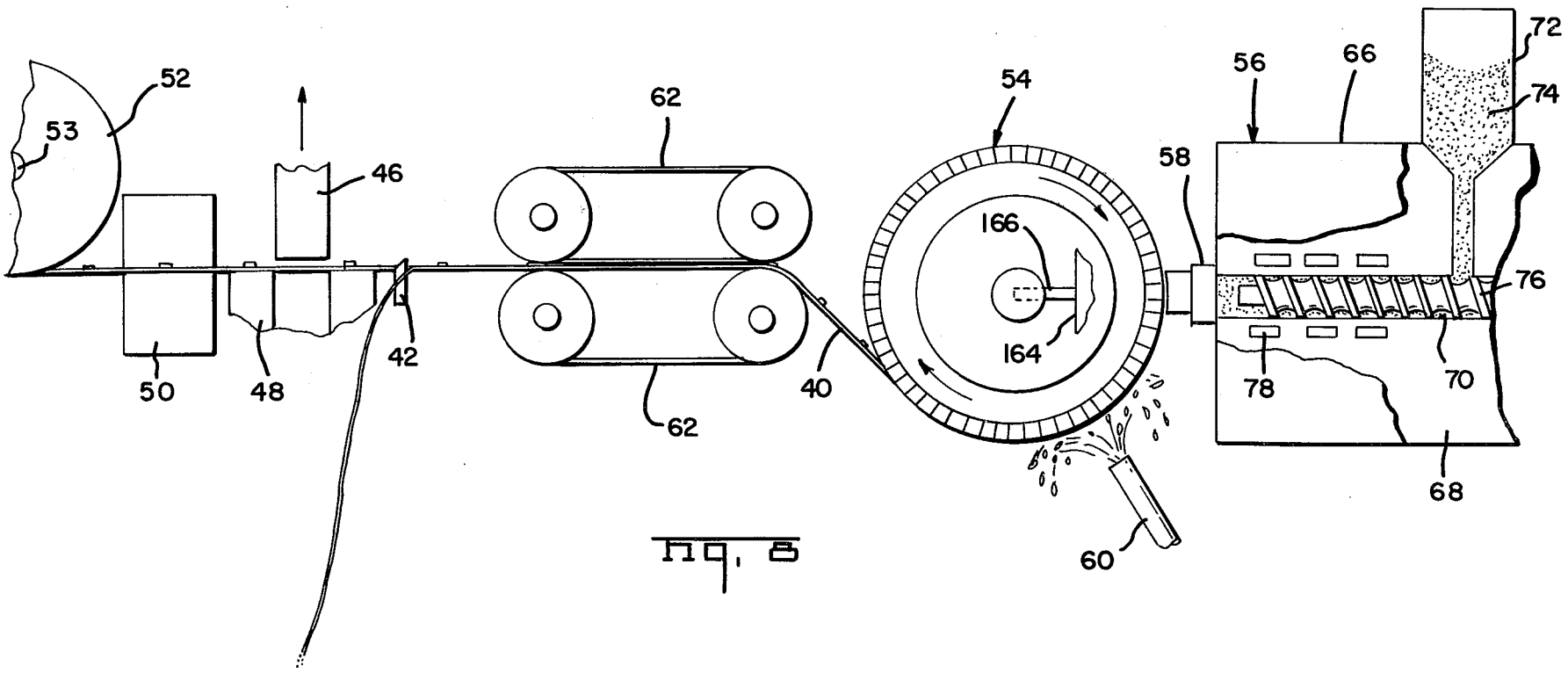

FIGS. 6 and 7 are views taken along the lines 6—6 and 7—7 of FIG. 5.

FIG. 8 is a semi-diagrammatic side view of an apparatus for producing endless strip in accordance with the invention.

Figure 9:
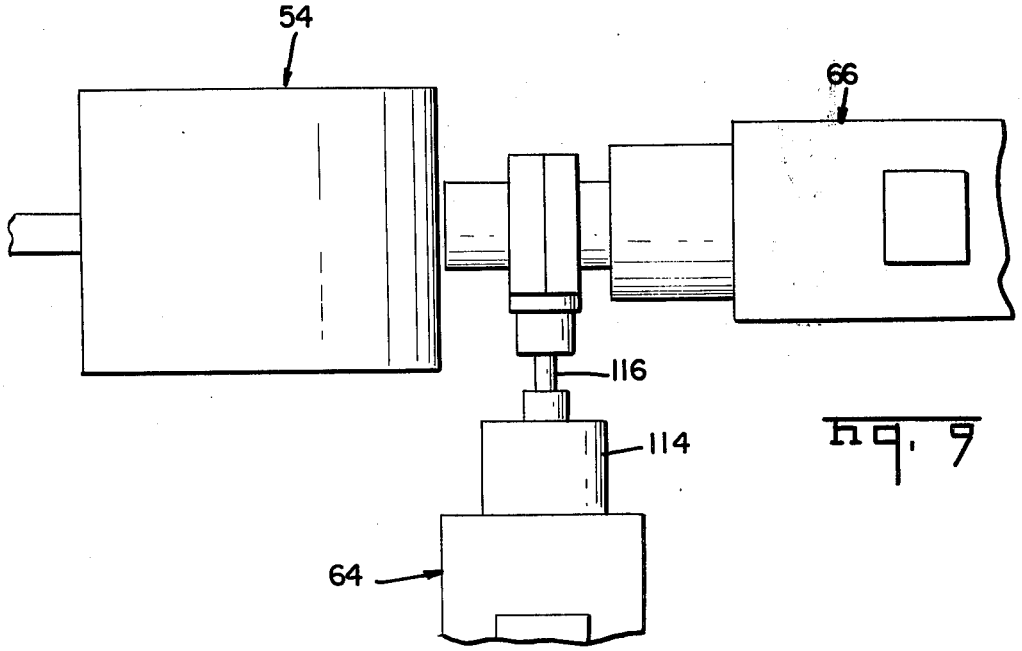

FIG. 9 is a semi-diagrammatic fragmentary plan view of portions of the apparatus.

Figure 10:
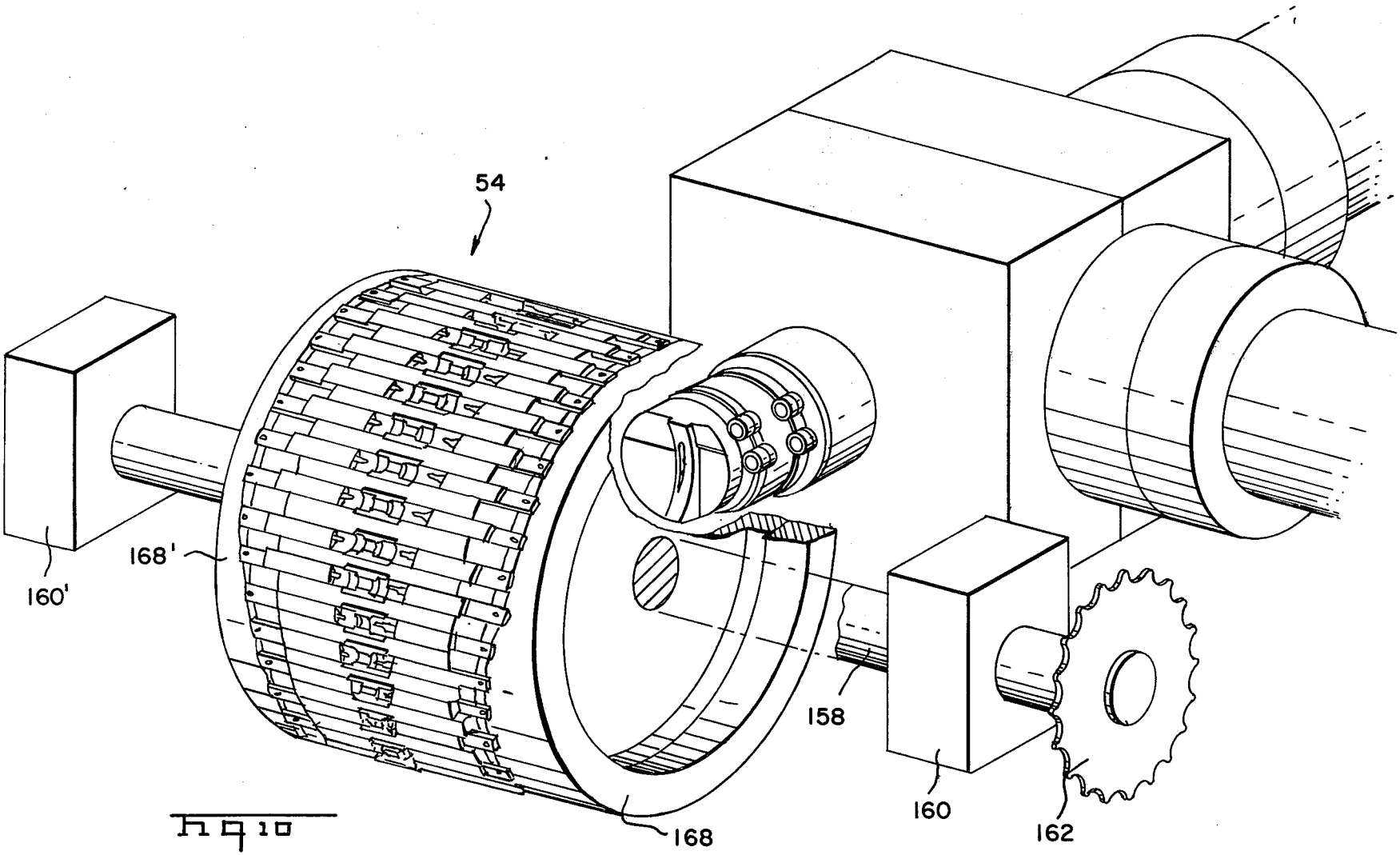

FIG. 10 is a perspective view showing the molding wheel which forms part of the apparatus and illustrating its relationship to the injection molding nozzle.

Figure 11A:
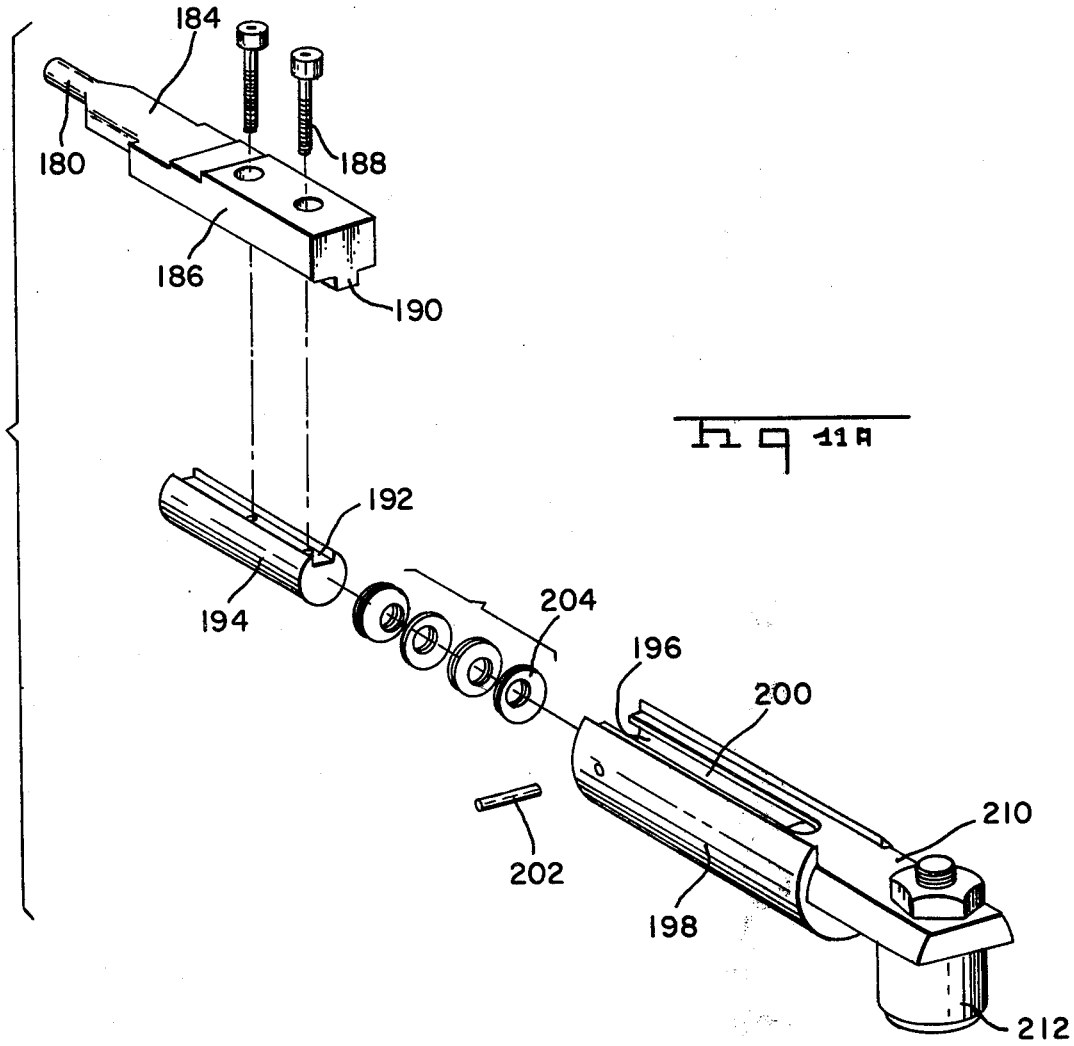
Figure 11:
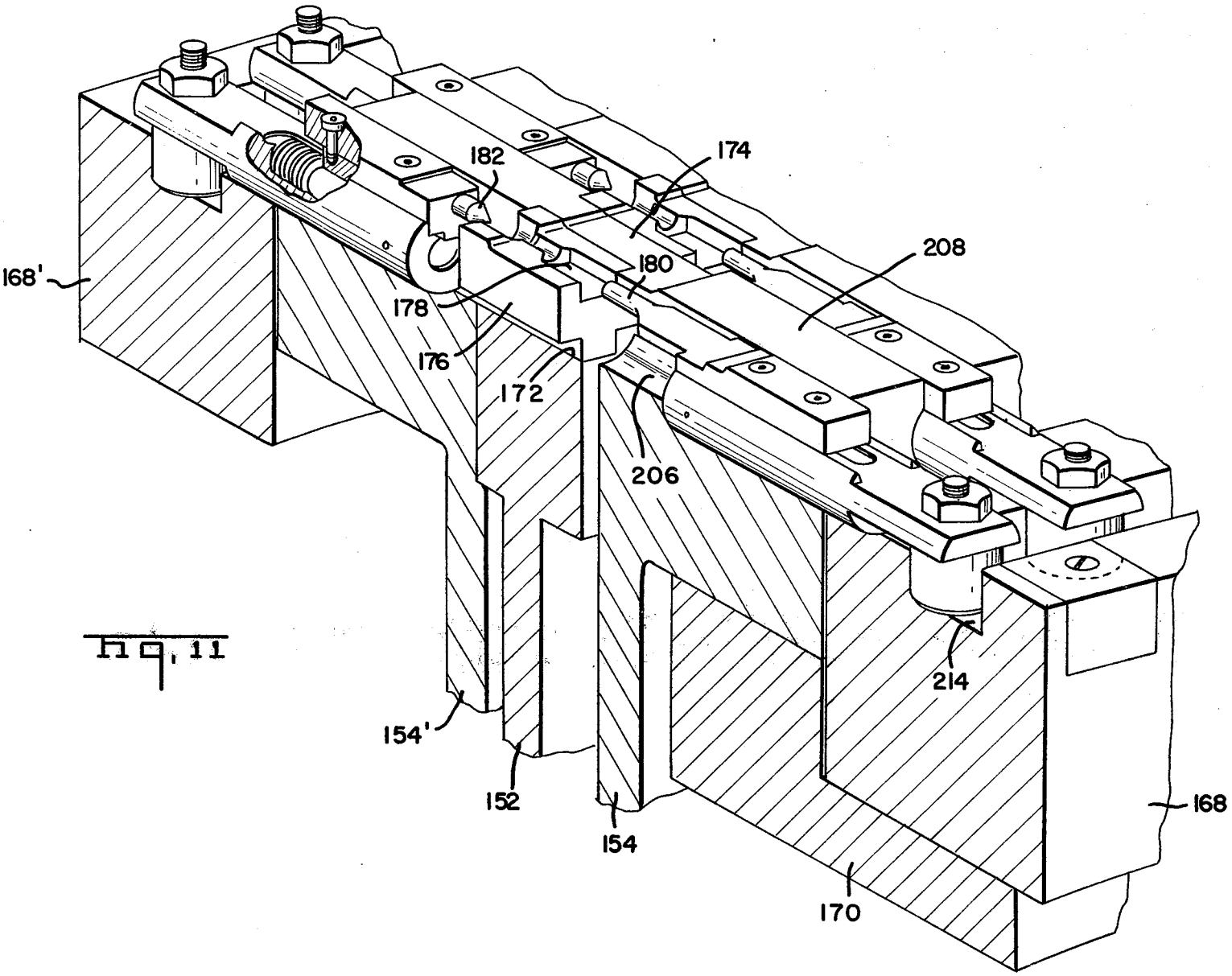

FIG. 11 is a fragmentary perspective view of a portion of the molding wheel.

FIG. 11A is an exploded perspective view of one of the core pin assemblies of the molding wheel.

Figure 12:
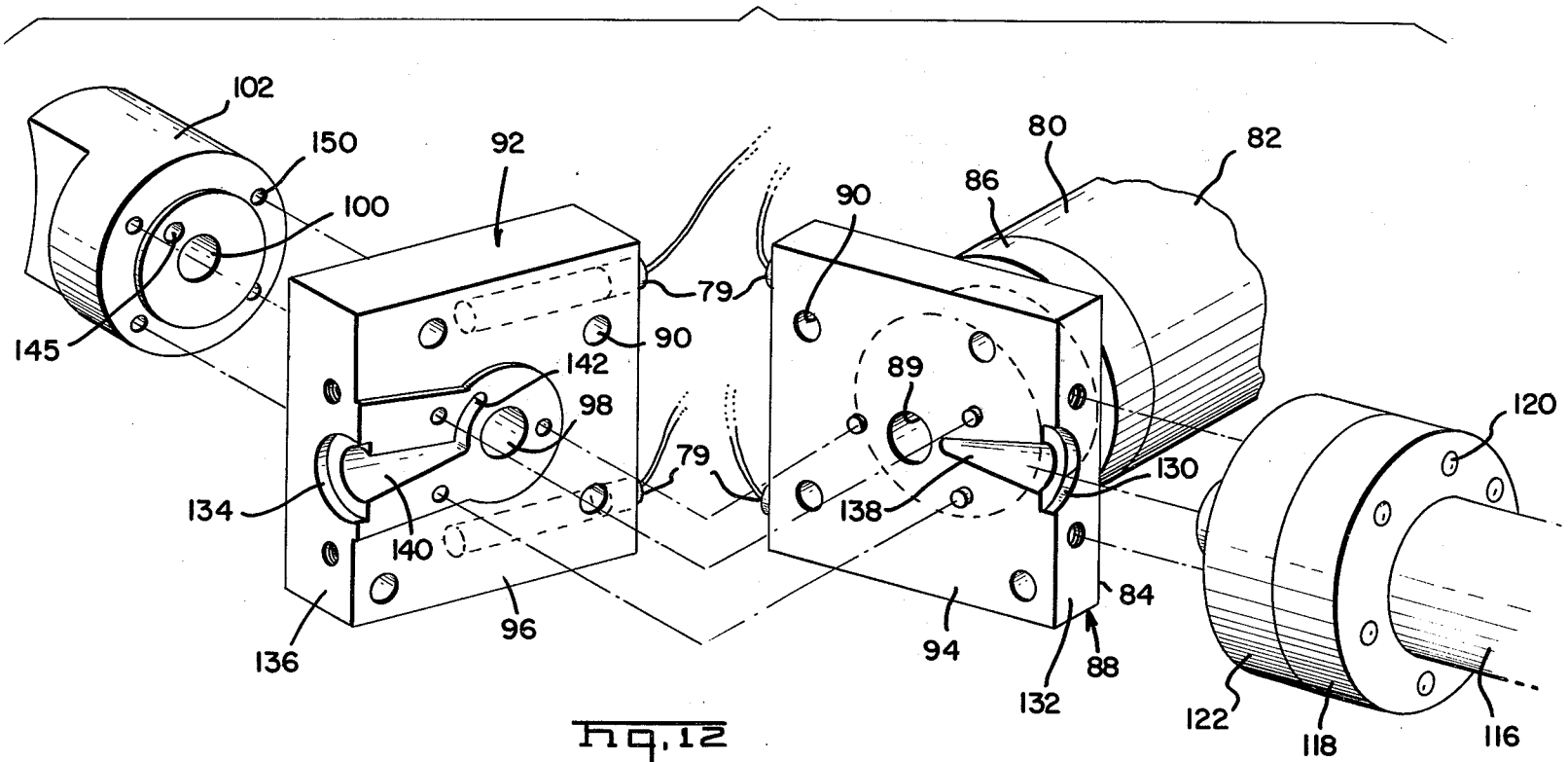
Figure 17:
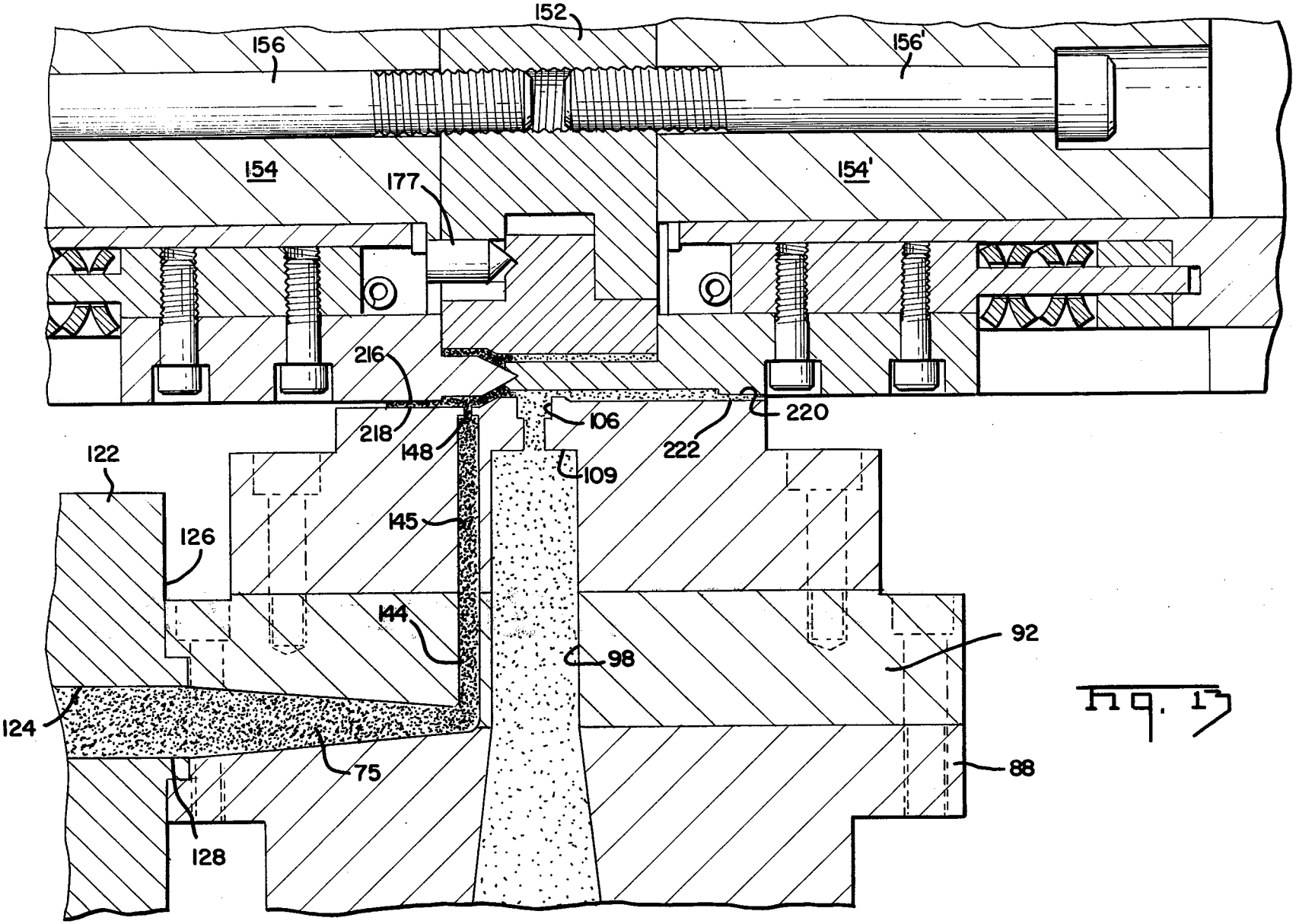

FIG. 12 is an exploded view showing the nozzle assembly and related parts of the apparatus.

FIG. 13 is a sectional view, on an enlarged scale, taken through the nozzle portion of the apparatus and through portions of the molding wheel, this view illustrating the manner in which two different materials are injected into the individual mold cavities as they move past the nozzle apparatus.

Figure 14:
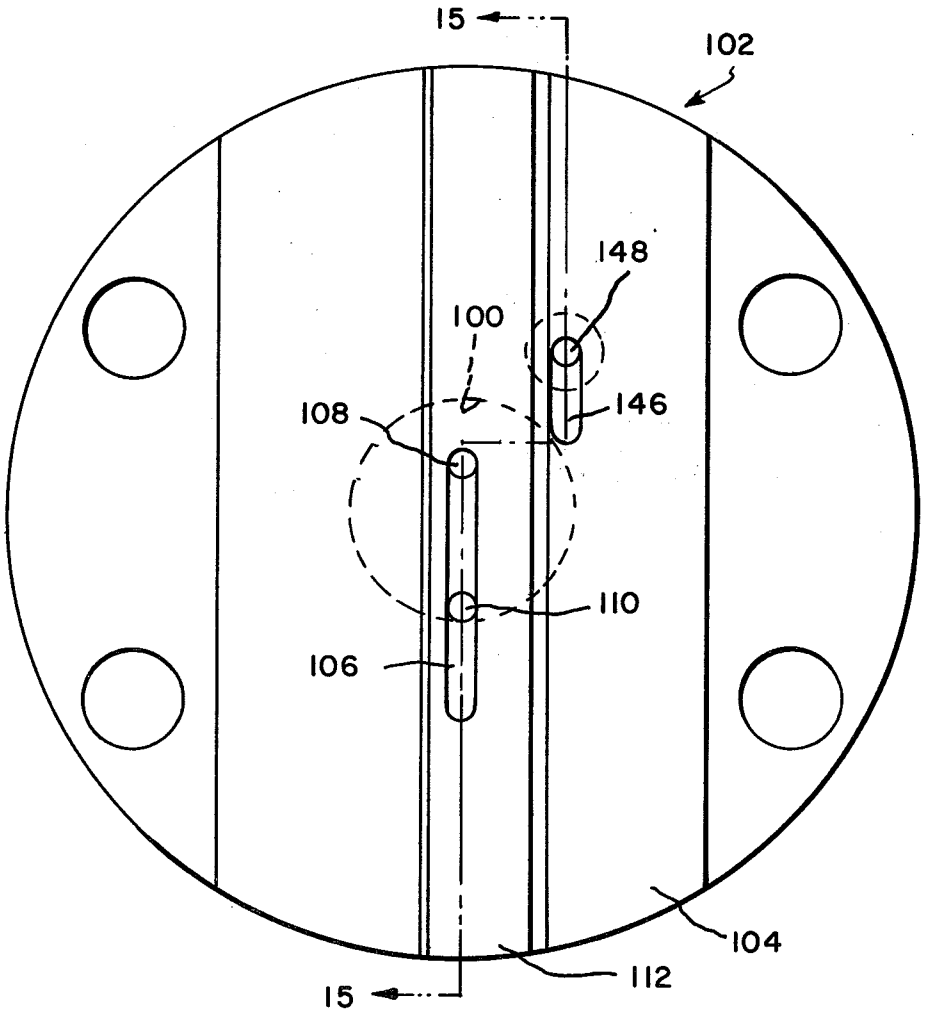

FIG. 14 is a frontal view of the nozzle.

Figure 15:
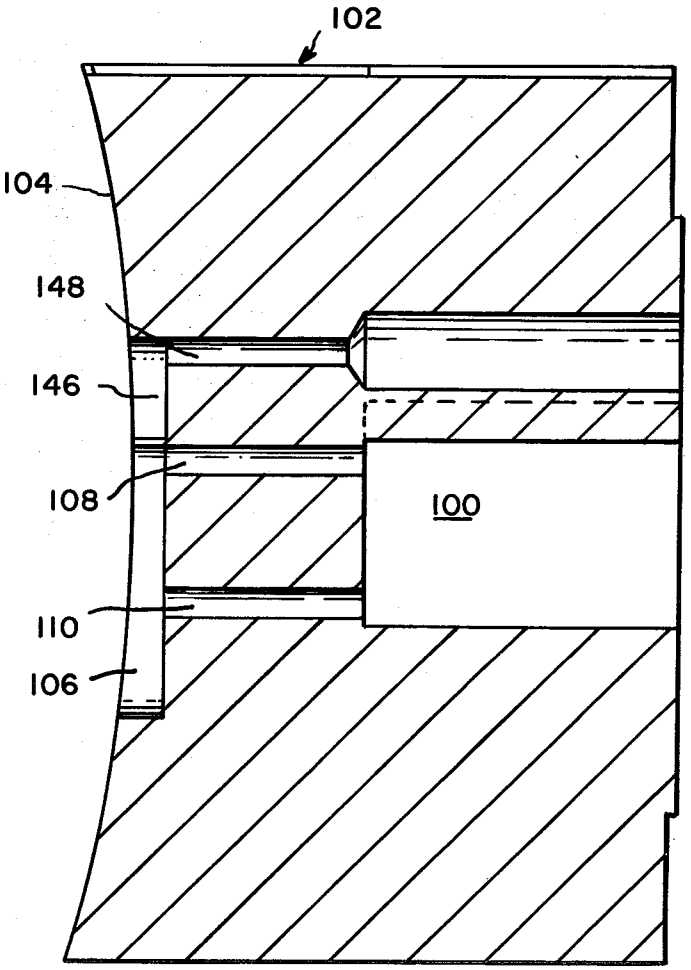

FIG. 15 is a view taken along the lines 15—15 of FIG. 14.

FIG. 1 shows a section of strip 2 of housings 4 in accordance with the invention. The strip comprises a continuous carrier strip 6 from which the housings 4 extend at spaced-apart intervals. Each housing has a relatively wide and generally rectangular frontal portion 8 which is integral with the carrier strip 6, an intermediate constricted portion 10, and an enlarged wire-receiving end portion 12 which is generally cylindrical but which has a substantially flat lower surface. The three sections of each housing merge with each other at transition zones as shown at 11 and 13.

Each housing has a cavity extending therethrough transversely of the length of the strip, each cavity having a general cylindrical wire-receiving end portion 14, an intermediate constricted portion 16, and a frontal portion 18 which is relatively wider than the other portions of the housing. As shown in FIG. 2, the downwardly facing surface portions of the housing are generally flat as shown at 20, 22, and 24, the intermediate surface 22 being recessed from the surface 20 which is coplanar with the lower surface of the carrier strip 6. The downwardly facing surface 24 of the free end portion 12 of the housing is slightly lower as viewed in FIG. 6 than the surface 20 and has a thicker wall as shown. The flat surface on the underside of the strip as shown at 20, 22, and 24 are produced as a result of the manufacturing process which is described below and constitutes one of the characteristics or features of endless strip in accordance with the invention which distinguish it from strip housings which may have been produced by other methods.

The portion 10 of each housing constitutes a wire barrel crimp portion as will be explained below while the portion 12 and the cavity portions 14 thereof constitute an insulation-receiving end of the housing. In use, the stripped end 32 of a wire is inserted into the cavity in the housing until the stripped end is disposed in the cylindrical barrel portion 30 of a terminal 26 (FIG. 5) and the end portion or section of the insulation is disposed in the section 14 of the cavity. Thereafter, the connecting device is crimped onto the wire as shown at 36 and 38 in FIG. 4 by suitable crimping tooling. These crimping forces are transmitted through the walls of the section 10 to the wire barrel portion 30 of the terminal so that the terminal is crimped onto the stripped end 32 of the wire. At the same time, the portion 12 of the housing is crimped securely onto the insulation of the wire so that a seal is obtained to prevent the passage of moisture therepast and a good mechanical coupling is also obtained between the housing and the insulation of the wire.

The mechanical coupling achieved by the crimp 38 will remain secure only so long as the plastic material in the portion 12 of the housing does not relax after crimping and many thermoplastic materials will undergo some relaxation. For this reason, the portion 12 of each housing is of a first material which will resist such relaxation, one suitable material being an aromatic nylon which is always amorphous. For example, a suitable aromatic nylon is obtainable under the trade name Trodamid and is supplied by Dynamit Nobel of the United States of Norwood, N.J. This material is relatively unusual as compared with commonly used thermoplastic and it is ideally suited for the crimp portion 12 of the housings 4.

The wire barrel crimp portion 10 of each housing and the frontal portion 8 are of a second material which has somewhat different properties in that it is relatively crystalline as compared to the aromatic nylon in the section 10. Many of the commonly available filled nylon compositions can be used for this portion of the housing so long as the composition will withstand the compressive crimping forces which are applied when the portion 10 is crimped. After such crimping of the portion 10 the housing may relax somewhat in the crimp area 36 but such relaxation is not harmful, and, in fact, it may be beneficial in that the resulting air gap between the interior surface of the housing and the surface of the wire barrel portion 30 of the terminal improves the dielectric characteristics of the crimped termination shown in FIG. 4.

The two materials used in the strip must be compatible which is to say that they must flow together during molding and bond to each other. The two materials noted above, an aromatic nylon and 6—6 nylon, do bond to each other and form a boundary zone which is illustrated by the oppositely directed cross hatching lines in FIG. 2.

The method and apparatus for producing thermoplastic strip in accordance with the invention will now be described. FIGS. 8 and 9 show the general principles of the manufacturing process and these general principles will be described at the outset prior to the description of the detailed features of the apparatus.

The injection molding apparatus (FIGS. 8–15) for molding the strip 2 comprises first and second injection molding machines 64, 66 which are disposed at right angles to each other and which have their molding heads coupled to an adapter and nozzle assembly shown at 58. This nozzle assembly is located adjacent to the surface of a continuous rotating molding wheel 54 which has an endless series of side-by-side cavities in its surface. During rotation of the wheel and movement of the cavities past the nozzle assembly 58, the cavities, and surface portions of the wheel between adjacent cavities, are filled with viscous flowable molding material of both compositions described above. After the wheel rotates past the nozzle assembly, the molding material in the cavities is subjected to a cooling water stream 60 and the strip is solidified. The strip is removed from the molding wheel by endless continuously moving belts 62 and the strip is also pulled leftwardly as viewed in FIG. 8 by a driven reel 52 which continuously rotates and pulls the strip from the belts to the reel upon which the strip is wound.

FIG. 5 shows the strip material, in its condition as it is, removed from the molding wheel. The strip 41 has slightly irregular side edges 41 and thin web material 44 extends between adjacent housings 4 on the strip although the housings themselves are fully formed at this stage. The driven taken up reel 52 pulls the strip past spaced-apart trimming blades 42 which trim the side edges as shown in FIG. 5 and past a punch and die set 46, 48 which blanks out and removes the web material 44 between adjacent housings 4. Finally, the electrical contact terminals 26 are inserted into the housings by a suitable insertion apparatus indicated at 50. Each terminal has a receptacle portion 28 which is disposed in the forward portion 18 of the cavity in the housing and a wire barrel portion 30, previously described, which is disposed in the intermediate constricted portion 16 of the cavity in the housing. The reel 52 is preferably of a type which can be removed from the shaft 53 on which it is mounted and shipped to the ultimate user who then mounts the same reel on a terminal applicator which has tooling for feeding the strip to the crimping dies from the reel.

The second injection molding machine 66 of the molding apparatus 56 serves to inject the second material into the cavities in the molding wheel 54 and is the larger of the two molding machines. This second molding machine comprises a body 68 having a passageway 70 extending therethrough and a continuously rotating screw 76 in the passageway. The molding powder 74 is fed by gravity to the passageway 70 from a hopper 72 and as the molding powder moves leftwardly in FIG. 8, it is softened and rendered flowable by heating units 78 in the body 68. The passageway 70 in the body 68 communicates with a passageway in an extrusion head 80 (FIG. 12) and a suitable adaptor 86 is mounted on the end of the extrusion head to couple the extrusion head to two junction blocks 88, 92. These blocks and the nozzle described below constitute the nozzle assembly 58 referred to above. The block 88 has a passageway 89 extending therethrough which is in alignment with passageway 70 through which the second molding material flows during operation. Suitable band heaters may be provided on the extrusion head 80 of the injection molding apparatus 66 and on the corresponding parts of the molding apparatus 64. Also, suitable heating elements 79 may be provided in the block sections 88, 92 as required to maintain the molding material in a viscous flowable state. The two blocks 88, 92 are secured to each other by fasteners which extend through aligned openings 90 and suitable aligning pins as shown may be provided to ensure that the blocks will be assembled to each other in their proper relationship.

The block 92 is provided with a passageway 98 which is in alignment with passageway 89 when the faces 94, 96 of the blocks 88, 92 are against each other and the passageway 98 is in alignment with a passageway 100 in the nozzle 102. This nozzle is secured against the block 92 by suitable fasteners which extend through openings 150.

The nozzle 102 has an arcuate face 104, shown best in FIGS. 14 and 15, which conforms to the curvature of the surface of the molding wheel 52 as described below and a central rib 112 extends across this face parallel to the direction of rotation of the molding wheel. Passageway 100 in the nozzle has an inner end wall 109 which is adjacent to face 104 and spaced-apart orifices 108, 110 extend through the inner end wall of the passageway 100 and open into an elongated well 106 in the central rib 112 of the face of the nozzle. Two such orifices 108, 110 are provided to achieve uniform flow of extrudate towards the molding wheel and filling of the mold cavities as they pass the face of the nozzle.

The first injection molding machine 64 has an extrusion head 114 and is otherwise generally similar to the second molding machine 66 described above although the first machine 64 is of a somewhat smaller capacity by reason of the fact that it injects a lesser amount of material into the mold cavities during operation. An extension adaptor 116 is provided on the end of extrusion head 114 and has a passageway extending therethrough which is in alignment with the passageway 124 in a cylindrical adaptor 122 (FIGS. 9 and 13). Suitable bolts as shown at 120 are provided to secure the adaptor 122 against the end flange 118 of the extender 116. The face 126 of adaptor 122 (FIG. 13) which is adjacent to the junction block assembly 88, 92 has a central circular boss 128 which surrounds the passageway 124. This boss is dimensioned to be received in a circular recess which is formed by semi-circular recesses 130, 134 in the side surfaces 132, 136 of the block parts 88, 92 respectively. The face 94 of the block 88 has a conical recess 138 therein which extends from the inner end of the half round recess 130 towards the passageway 89. The face 96 of the block 92 has a similar conical recess 140 therein so that when the two blocks 88, 92 are assembled to each other, a conical passageway is defined which extends from the side surfaces 132, 136 to an arcuate passageway 142 in the block 92. Passageway 142 extends arcuately upwardly as viewed in FIG. 12 and communicates with a passageway 144 which extends through block 92 parallel to the passageway 98, see FIG. 13. Passageway 144 is in alignment with a passageway 145 which extends through the nozzle 102 parallel to the passageway 100 and which opens into a well 146 in the face of the nozzle, this well being located on a surface portion of the nozzle which is beside the central rib 112. It will be noted that the orifice 148 and well 146 are above, as viewed in FIG. 12, the well 106 so that during movement of the molding wheel past the nozzle, injection of the first material 75 which ultimately becomes the insulation support section 12 of the terminal housing will commence prior to injection of the second material 74. The locations of these orifices can be changed as desired to control the rate of filling the mold cavities and the amount of the two materials which are injected into the cavities.

Turning now to FIGS. 10 and 11, the molding wheel 54 is comprised of three rotating parts, a central part or section 152 and side sections 154, 154' these parts being secured to each other by suitable bolts 156, 156' (FIG. 13). The three parts of the molding wheel are keyed or otherwise secured to a shaft 158 which is supported in suitable bearings 160, 160'. The shaft has a sprocket 162 on one of its ends which is coupled by a suitable chain to a driving motor (not specifically shown) capable of rotating the shaft at a controlled speed.

Stationary camming rings 168, 168' are mounted adjacent to each side of the rotating portions of the wheel and are supported on mounting rings 170. The mounting rings are supported on the shaft 158 although they do not rotate with the shaft. The assembly comprising the camming rings and the molding wheel are adjustably mounted with reference to the extrusion nozzle so that they can be moved by small increments towards and away from the face 104 of the nozzle. A stop means 164 and adjustment means 166 are shown in FIG. 8 may be of any suitable type such as adjusting screw and a framework for the wheel slidably supported on guideways. This positioning means for the wheel permits precise adjustment of the gap between the surface of the nozzle and the surface of the molding wheel thereby to permit precise control of the molding process.

A series of side-by-side transversely extending recesses 172 are provided in the surface 174 of the central section 152 of the wheel and an opened faced mold 176 is mounted in each of these recesses. Each mold 176 is retained in its respective recess by a set screw 177 which projects into a recess in the mold. Each mold has a mold cavity 178 which conforms to the contours of the individual housings. Surface portions of each mold as well as surface portions of the wheel sections 154, 154' are contoured to control the thickness and the contour of the finished strip. The cavities in the molded housings 4 are provided by core pins 180, 182 which move into the mold cavities 178 prior to movement of a given mold past the extrusion nozzle 102 and which are withdrawn from the mold prior to stripping of the strip from the surface of the molding wheel. The core pins 180, 182 are dissimilar since the core pin 182 produces the cavity portion 14 while the core pin 180 produces the wide portion 18 of the housing cavity. However, the core pin assemblies are otherwise identical and a description of one will suffice for both. The core pin assembly shown on the right in FIG. 11 is, therefore, described in detail and the same reference numerals are differentiated by prime marks on the corresponding parts on the core pin assembly on the left.

Each core pin 180 (FIG. 11A) has an enlarged portion 184 which forms the enlarged portion of the housing cavity and the enlarged portion of the core pin is integral with a mounting block portion 186 that has a rib 190 on its lower surface as viewed in FIG. 11A. The rib is received in a groove 192 in a cylindrical mounting member 194 and the core pin is secured to the member 194 by fasteners 188. The member 194 is received in a cylindrical bore 196 and a slide member 198, a slot and recess indicated at 200 being provided in the slide 198 for reception of the rib 190. Spring washers 204 are interposed between the end of the mounting member 194 and the inner end of the bore 196. The mounting member 194 is maintained in the bore 196 by a pin 202 which extends through the end of the slide 198. It will be apparent that the mounting member 194 is biased by the stiff springs 204 against the pin 202 but this mounting member can move against the biasing force of the springs 204 relative to the slide 198. This arrangement ensures snug seating of the ends of the core pins against each other as shown in FIG. 13 when they are disposed in the mold cavity.

A plurality of generally cylindrical recesses 206 are provided in the surface 208 of the wheel part 154 and the slide members 198 are slidably received in these recesses. Extensions 210 of each slide member 198 project beyond the wheel part 154 and over the surface of the camming ring 168 and a cam follower 212 on the end of this extension 210 is received in the cam track 214 in the surface of the stationary camming ring 168. The cam tracks 214, 214' are contoured such that during continuous rotation of the wheel, the core pins are moved to their inner positions (FIG. 13) as the wheel moves from the nine o'clock position of FIG. 8 to about the two o'clock position thereof; that is, while there is no strip material 41 on the wheel and prior to movement of the mold sections past the nozzle. The core pins will be in their inner positions as the cavities move past the nozzle and will remain in the position of FIG. 13 until the strip has been chilled by the water spray 60. The core pins are extracted by the cam tracks prior to stripping of the strip 40 from the wheel so that the housings 4 can be removed from the cavities.

During continuous operation of the apparatus to produce a substantially endless strip 2, the first molding 75 material will flow from the first extruder through the passageway 124, 144, 145 to the well 146 in the face of the molding wheel and the second material 74 will flow through the passageway 89, 98 to the well 106 of the nozzle. As the surface of the wheel moves past the nozzle, the two materials fill each mold cavity and fronts of the materials, the leading surfaces of the flowing materials, merge in the cavity and form the boundary zone in the transition sections of the individual housings. The molding material moves laterally as shown in FIG. 13 but the opposed surfaces of the core pins and the nozzle as shown at 216, 218, 220, 222 are relatively close together so that the viscous material does not flow laterally beyond the nozzle. Chilling of the molding material in the mold takes place rather rapidly as the rotating wheel moves past the orifices so that further flow of maerial beyond the positions shown in FIG. 13 is resisted. Complete solidification of the material takes place within an extremely short time as the mold cavities move past the water spray.

A continuous strip comprising at least two different and compatible molding materials in accordance with the invention will have many distinguishing characteristics by which it can be recognized. The presence of the two different materials in the strip will quite often be obvious upon casual observation with the unaided eye and analysis and testing of the strip reveal further differences. For example, the two materials may have different chemical compositions or different structures, and, of course, dissimilar physical properties. As pointed out in Application Ser. No. 734,708, continuously molded strip material in accordance with the teachings of the invention disclosed in that application may also be recognized by the sheared out sections between adjacent housings and between flat surfaces on the undersides of the housing and the strip, these surfaces being formed by the surface of the nozzle which is adjacent to the surface of the wheel as shown in FIG. 13.

A wide variety of useful articles can be produced in accordance with the teachings of the invention. For example, many types of electrical connecting devices might be produced other than the specific embodiment of the invention disclosed herein, such as continuous strips of electrical housing material which can be cut to any desired length to produce a multi-contact electrical connector. Crimpable portions can be provided on each housing in accordance with the teachings of the instant invention. The principles of the invention can also be used in the manufacture of other plastic articles such as fasteners or individual parts which are later assembled to other parts to produce a composite multi-part article or machine.

A variety of conditions and circumstances might render expedient the use of the invention. For example, a continuous strip in accordance with the invention might be composed of two different materials for reasons of economy; the carrier strip 4 of the strip shown in FIG. 1 is not a critical portion of the strip and this section of the strip might be produced with scrap molding material which has been reground and recycled. The housings themselves would, of course, be made of a higher quality material capable of satisfying all of the mechanical and electrical requirements which must be met. Under other circumstances, there may be a requirement for a glass filled thermoplastic material in one portion of each housing but the remaining portion need not be glass filled or otherwise filled and two materials could be simultaneously injected in accordance with the principles of the invention to manufacture the strip at a minimum cost.

What is claimed is:

1. A continuous strip of thermoplastic articles, each of said articles having first and second portions, said first and second portions constituting first and second bands which extend along the length of said strip, all of said first portions being of a first thermoplastic material and all of said second portions being of a second theromplastic material, said first and second materials beng joined together at the boundary separating said first and second bands, said first and second materials having optimum properties for said first and second portions of said articles, said strip having been manufactured by continuously extruding said first and second materials through adjacent orifice means in a nozzle means and into an endless series of side-by-side cavities having the same form as said articles while said cavities were moving past said nozzle.

2. A continuous strip as set forth in claim 1, each of said articles comprising an electrical connector housing, said second portion of each housing comprising a wire barrel crimp portion intended to contain a metallic wire barrel of a terminal, said first portion comprising an insulation crimp portion intended to receive insulation on a wire upon insertion of said wire through said insulation crimp portion to position the end of said wire in said wire barrel crimp position, said first theromplastic material being rigid and resistant to extrusion upon crimping, said second thermoplastic material being permanently deformable upon crimping whereby upon crimping of said crimp portions, said first portion is permanently crimped onto said insulation.

3. A continuous strip of thermoplastic articles as set forth in claim 1, said articles being in side-by-side spaced-apart relationship along the length of said strip, and carrier strip means extending between, and integral with, adjacent articles, said strip having been manufactured by the additional strip of cutting-out material from said strip between adjacent articles.

4. A continuous strip as set forth in claim 3, each of said articles comprising an electrical connector housing having a cavity extending therethrough transversely of the length of said strip, said first portion of each article comprising a first crimpable portion of each of said housings, said first material comprising an amorphorous nylon material.

5. A continuous strip as set forth in claim 4, said second portion of each article comprising a second crimpable portion of each housing and a contact-receiving portion of each housing, said first crimpable portion being at one end of each housing and said contact-receiving portion being at the other end of each housing with said second crimpable portion being between said ends, said housing being intended to receive a metallic contact terminal having a wire barrel portion and a contact portion, said second crimpable portion being dimensioned to receive said wire barrel portion and said contact-receiving portion of each housing being dimensioned to receive said contact portion of said terminal.

6. A substantially endless strip of electrical connector devices which are intended for crimping onto the stripped end of an insulated wire:

each of said connector devices comprising an insulating housing having a cavity extending therethrough and having an electrical contact terminal disposed in said cavity, each of said housings having a first crimpable portion which is at one end of said housing, a second crimpable portion which is intermediate the ends of said housing, and a contact-receiving portion, each of said contact terminals having a contact portion and a wire barrel crimp portion, said wire barrel crimp portion of each contact terminal being disposed in said second crimpable portion of its respective housing and said contact portion being disposed in said contact receiving portion, said first crimpable portion of each housing being of a first thermoplastic material and other portions of each of said housings being of a second material, said first material comprising a permanently deformable thermoplastic material which, after crimping, will remain in its crimped and deformed condition, said housings being in side-by-side relationship with said cavities extending transversely of the length of said strip, said strip having carrier strip means integral with said housings, each of said connector devices being crimpable onto an insulated wire upon insertion of a wire into said first crimpable portion until the stripped end of said wire barrel portion is disposed in the wire barrel portion of the terminal and the insulation of the wire is in said first crimpable portion, and upon crimping of said first and second crimpable portions, said wire barrel will be crimped onto said stripped end and said first crimpable portion will be permanently crimped onto said insulation.

7. A pre-insulated electrical connecting device which is intended to be crimped onto a wire comprising:

an insulating housing having a cavity extending therethrough, an electrical contact terminal in said cavity, said terminal having a contact portion and a cylindrical wire barrel portion, said wire barrel portion being dimensioned to receive the conducting core of said wire and being intended to be crimped onto said conducting core, said housing having a wire barrel crimp portion and an insulation crimp portion, said wire barrel portion of said terminal being disposed in said wire barrel crimp portion of said housing, said insulation crimp portion being integral with, and extending from, said wire barrel crimp portion at one end thereof, said insulation crimp portion being intended to receive, and be crimped onto, the insulation of said wire, said wire barrel crimp portion and said insulation crimp portion being of dissimilar and compatible polymeric materials, said insulation crimp portion being of a permanently deformable material which, upon crimping onto the insulation of a wire will maintain its crimped relationship, said housing having been manufactured by simultaneous injection of said two different materials into a mold cavity.

8. A connecting device as set forth in claim 7, said housing having a terminal contact-receiving portion integral with said wire barrel crimp portion at the end thereof which is opposite to said one end, said contact portion of said terminal being disposed in said terminal contact-receiving portion of said housing.

9. A method of manufacturing composite thermoplastic articles in continuous strip form comprising the steps of:

providing an endless series of side-by-side mold cavities for said articles in an endless surface, continuously moving said endless surface past an extrusion nozzle having first and second orifice means therein, extruding a first thermoplastic material through said first orifice means into said cavities and a second thermoplastic material through said second orifice means into said mold cavities as said cavities move past said orifice means whereby, said first and second materials fill said cavities and fronts of said first and second materials meet in each cavity and are fused to each other when said first and second materials freeze, and upon stripping the solidified strip from said surface, said strip will comprise side-by-side bands of said first and second materials and said first and second materials will comprise first and second portions of each article in said strip.

10. A method as set forth in claim 9 including the steps of removing portions of said thermoplastic material between adjacent articles in said strip.

11. A method as set forth in claim 9, said method being directed to the manufacture of electrical connector housings in side-by-side strip form with each of said housing having a cavity extending therethrough transversely of the length of said strip, each of said housings having a first portion comprising said first material and a second portion comprising said second material.

12. A method as set forth in claim 11, said first portion comprising a crimp portion, said first material comprising a permanently deformable thermoplastic material.

13. A method as set forth in claim 12 including the step of punching out portions of the thermoplastic material between adjacent connector housings in said strip.

* * * * *